US006315040B1

(12) United States Patent
Donnelly

(10) Patent No.: US 6,315,040 B1
(45) Date of Patent: Nov. 13, 2001

(54) EXPANDABLE WELL SCREEN

(75) Inventor: Martin Donnelly, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/071,792

(22) Filed: May 1, 1998

(51) Int. Cl.[7] ..... E21B 43/08
(52) U.S. Cl. ..... 166/207; 166/230; 166/233
(58) Field of Search ..... 166/230, 233, 166/228, 231, 207, 381

(56) References Cited

U.S. PATENT DOCUMENTS

| | | | | |
|---|---|---|---|---|
| 2,812,025 | | 11/1957 | Teague et al. | 166/207 |
| 3,353,599 | | 11/1967 | Swift | 166/278 |
| 5,366,012 | * | 11/1994 | Lohbeck | 166/277 |
| 5,901,789 | * | 5/1999 | Donnelly et al. | 166/381 |

FOREIGN PATENT DOCUMENTS

| | | |
|---|---|---|
| WO 93/01460 | 7/1992 | (WO) . |
| WO 9604887A1 | 2/1996 | (WO) . |
| WO 97/17524 | 5/1997 | (WO) . |

OTHER PUBLICATIONS

International Search Report completed Aug. 10,1998.

* cited by examiner

*Primary Examiner*—George Suchfield

(57) ABSTRACT

An expandable well screen for preventing migration of sand or other solid particles into a hydrocarbon fluid production well comprises a number of filter sheets with circumferential slots, which sheets are secured in an iris-shaped configuration and co-axial to an expandable slotted carrier tube such that as result of expansion of the tube the amount of overlap between adjacent filter sheets is reduced. The circumferential slot pattern of the slots enables the filter sheets to slide easily relative to each other and to avoid buckling and/or tearing of the filter sheets during the expansion process.

5 Claims, 2 Drawing Sheets

EXPANDABLE WELL SCREEN

FIELD OF THE INVENTION

The invention relates to an expandable well screen for preventing migration of solid particles into a hydrocarbon fluid production well.

More particularly, the invention relates to an expandable well screen which comprises a number of filter sheets which are secured in an iris-shaped configuration and co-axial to an expandable slotted carrier tube such that as a result of expansion of the tube the amount of overlap between adjacent filter sheets is reduced.

BACKGROUND OF THE INVENTION

An expandable well screen is disclosed in applicant's co-pending U.S. patent application Ser. No. 08/745,391, filed on Nov. 8, 1996, now U.S. Pat. No. 5,901,789, which is incorporated herein by reference PCT/EP96/04887, which has issued as U.S. Pat. No. 5,901,789 and which is incorporated herein by reference.

FIG. 3 of this prior art reference discloses that the filter sheets consist of plates in which a series of circular perforations are present. The size of these perforations is chosen such that solid particles larger than the size of the hole are prevented from flowing into the well.

A suitable expandable slotted carrier tube for use with the screen is disclosed in U.S. patent application Ser. No. 72,290, filed on Jun. 7, 1993, now U.S. Pat. No. 5,366,012, which is incorporated herein by reference. PCT/EP93/01460, which has issued as U.S. Pat. No. 5,366,012, which is incorporated herein by reference.

It has been found that filter sheets which are secured to an expandable slotted carrier tube are deformed considerably during the process of expanding the carrier tube by moving an expansion mandrel therethrough. The carrier tube normally shortens during the expansion process as a result of opening of the axial slots towards a diamond shape.

This may cause the filter sheets to buckle to accommodate the carrier tube shortening and friction between the overlapping filter sheets and the carrier tube or tubes may cause the filter sheets to tear.

An object of the present invention is to provide a well screen comprising an iris-shaped configuration of filter sheets which do not buckle and which slide easily relative to each other and relative to the carrier tube during the process of expanding the carrier tube.

SUMMARY OF THE INVENTION

The well screen according to the invention thereto comprises filter sheets having slots which are oriented in a substantially circumferential orientation with respect to the carrier tube.

When used in this specification the reference to a circumferential arrangement of slots means that the slots each are directed in a substantially tangential orientation with respect to the carrier tube and such that the slots are oriented substantially transversal to the central axis and any axial slots of the carrier tube.

Preferably the filter sheets consist of elongate strips with staggered rows of slots in a transversal direction with respect to a longitudinal axis of each strip.

The pattern of slots is preferably such that alternate rows are displaced up to half a slot pitch in the transverse direction, the length of the slots is greater than half the transverse slot pitch, and the pattern of slots is continued through the longitudinal edges of the strips.

It is also preferred that each strip is secured at regularly spaced points along its length to the expandable slotted carrier tube and that each strip is secured to the expandable slotted carrier tube at said points by either spot welding, brazing, soldering, gluing, riveting or screwing the strip to the tube at each of said points.

These and further aspects, features and advantages of the well screen according to the present invention will become apparent from the accompanying claims, abstract and the following detailed description with reference to the drawings.

IN THE DRAWINGS

DETAILED DESCRIPTION OF THE INVENTION

Figure 1:
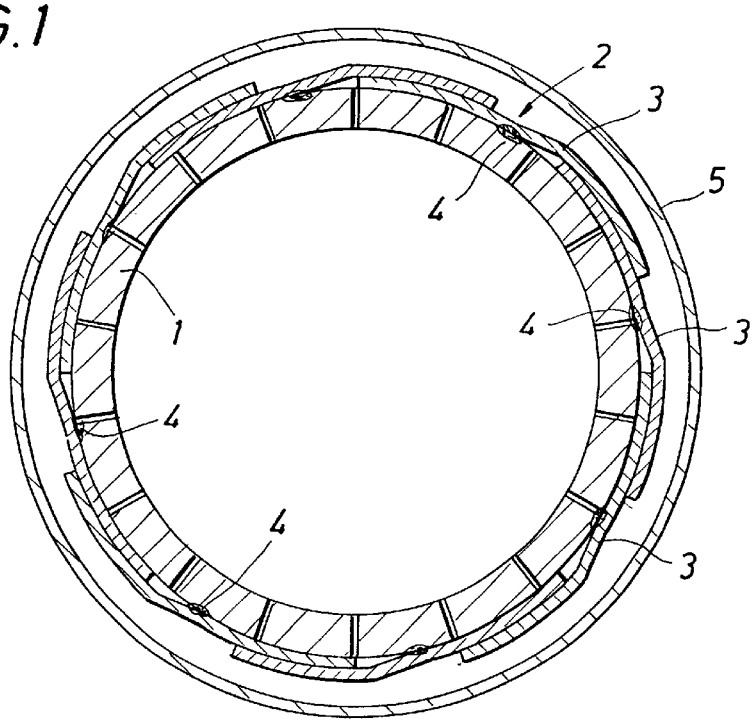
FIG. 1 is a cross-sectional view of a well-screen comprising an iris-shaped configuration of filter sheets according to the invention.
Figure 2:
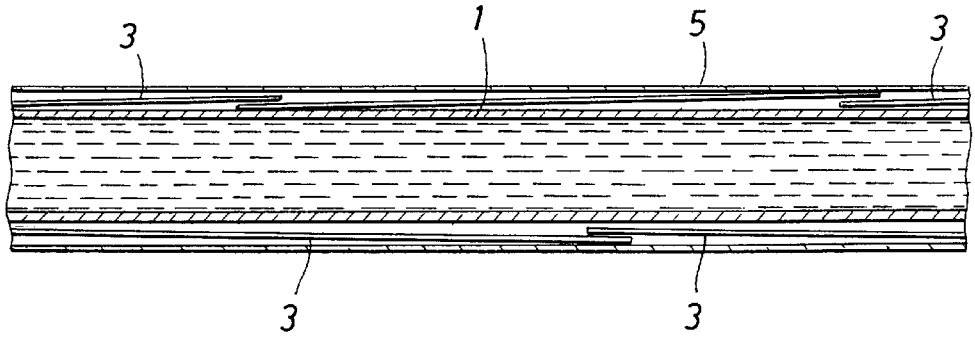
FIG. 2 is a longitudinal sectional view of the well screen of FIG. 1.
Figure 3:
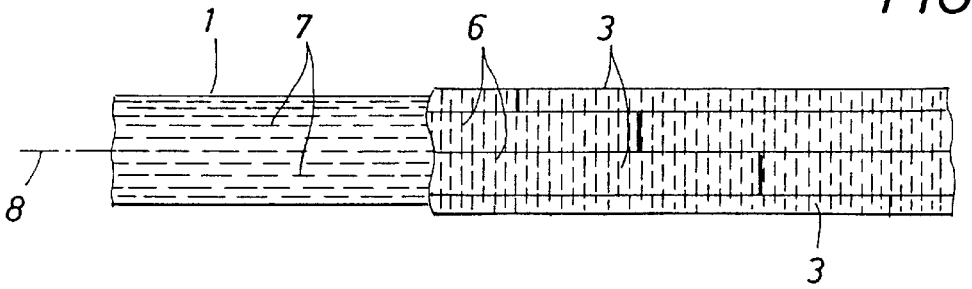
FIG. 3 is a side view of the well screen of FIGS. 1 and 2 in which the protective surrounding tube has been omitted.

Referring now to FIG. 1 there is shown an expandable slotted carrier tube 1 which is surrounded by a well screen 2 which comprises a series of filter sheets 3 which are arranged in an iris-shaped configuration around the carrier tube 1. As shown in FIGS. 2 and 3 the filter sheets 3 consist of elongate rectangular strips which are each, as shown in FIG. 1 secured to the carrier tube 1 at attachment points 4 located on or close to the longitudinal centreline of the filter sheet 3 by for example spot welding, brazing, soldering, gluing, riveting or screwing at regularly spaced points along the length of the carrier tube 1. The attachment points 4 are located on the nodes between the ends of the slots of the carrier tube 1.

Figure 4:
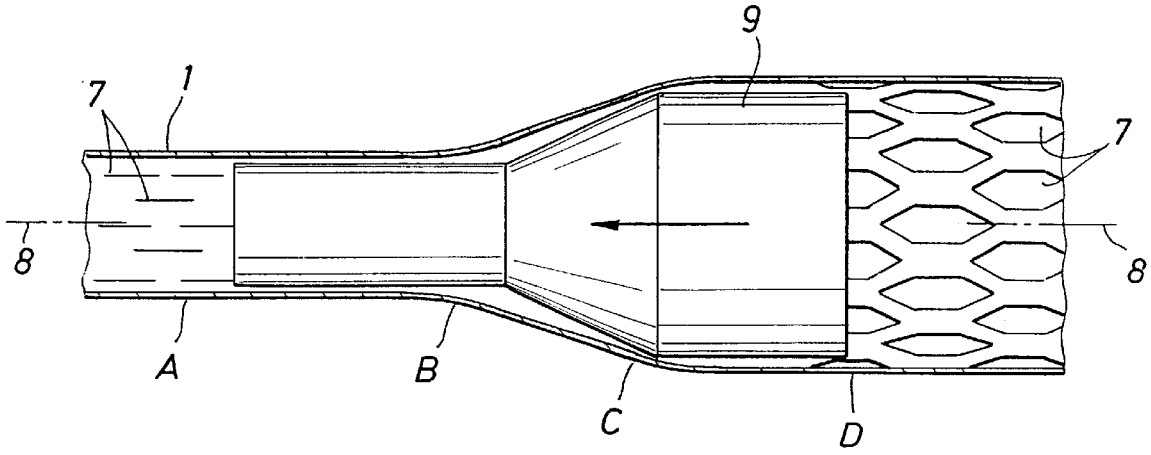
FIG. 4 and FIGS. 4A, B, C and D show the original shape and deformation of the circumferential slots near a longitudinal edge of the filter sheets before, during and after the expansion process.

The filter sheets 3 overlap each other in both axial and circumferential direction such that during and after the expansion process which is illustrated in FIG. 4 at least some overlap remains between adjacent filter sheets 3.

In FIG. 3 the protective surrounding tube 5 which is shown in FIGS. 1 and 2 has been omitted to show that the filter sheets 3 each comprise a series of staggered rows of circumferential slots 6 which are oriented in a substantially tangential direction with respect to the carrier tube 1 and substantially transversal to the axial slots 7 of the carrier tube 1 and to the central axis 8 of the carrier tube 1.

Figure 4A:
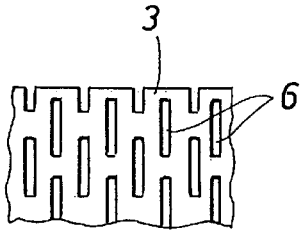

The preferred pattern of these slots, as previously described, is shown in FIG. 4A, in which alternate rows are displaced up to half a slot pitch in the transverse direction, and the length of the slots is greater than half the transverse slot pitch.

As shown in FIG. 4 the carrier tube 1 is expanded by an expansion cone 9 during the expansion process such that the axial slots 7 deform into a diamond shape.

Figure 4B:
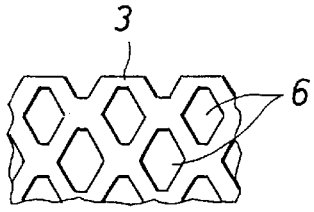
Figure 4C:
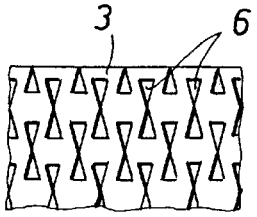
Figure 4D:
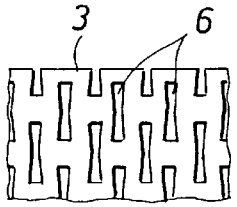

The expansion causes the carrier tube 1 to shorten and as illustrated in FIGS. 4A–D the circumferential slots 6 at and near the longitudinal edges of the filter sheets 3 will initially open up to the diamond shape shown in FIG. 4B, then close to the X-shape shown in FIG. 4C and then partly re-open again to the key-hole shape shown in FIG. 4D.

The illustrated sequential opening and closing of the circumferential slots 6 provides axial flexibility to the filter sheets 3 which prevents buckling or tearing of the fragile sheets 3 during expansion of the carrier tube 1.

The circumferential slots 6 also allow the overlapping sheets 3 to slide easily relative to each other during the expansion process.

It is observed that instead of arranging the filter sheets 3 in a longitudinal direction around the carrier tube 1 as illustrated in FIG. 3, the filter sheets 3 may also be arranged in a shallow helix around the carrier tube 1. In such case the helix angle should be selected small enough so that the deviation of the slots 6 from the tangential direction of the carrier tube 1 is less than 20 degrees.

We claim:

1. An expandable well screen for preventing migration of solid particles into a hydrocarbon fluid production well, the well screen comprising:

an expandable slotted carrier tube; and, a plurality of filter sheets, the filter sheets secured in an iris-shaped configuration and co-axial to the expandable slotted carrier tube wherein the filter sheets comprise:

elongate strips, each strip having a plurality of longitudinal edges;

slots, having a length, which are oriented in a substantially circumferential orientation with respect to the carrier tube in staggered rows in a transversal direction with respect to a longitudinal axis of each strip and having a pattern such that alternate rows are displaced up to half a slot pitch in the transverse direction and the length of the slots is greater than half the slot pitch in the transverse direction, and said pattern of slots is continued through the longitudinal edges of the strips; and, as a result of expansion of the slotted carrier tube the amount of overlap between adjacent filter sheets is reduced.

2. The well screen of claim 1, wherein each strip is secured at regularly spaced attachment points along its length to the expandable slotted carrier tube.

3. The well screen of claim 2, wherein each strip is secured to the expandable slotted carrier tube at said attachment points by using an attachment method selected from spot welding, brazing, soldering, gluing, riveting and screwing the strip to the tube at each of said points.

4. The well screen of claim 3, wherein the regularly spaced attachment point of each strip is located on a node between the ends of the slots of the expandable slotted carrier tube.

5. The well screen of claim 4, wherein the longitudinal axis of each strip is substantially parallel to a central axis of the carrier tube both before and after expansion of the carrier tube.

* * * * *